US007932799B2

(12) United States Patent
Loef et al.

(10) Patent No.: US 7,932,799 B2
(45) Date of Patent: Apr. 26, 2011

(54) TRANSFORMER

(75) Inventors: Christoph Loef, Aachen (DE); Bernd Ackermann, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 555 days.

(21) Appl. No.: 11/575,524

(22) PCT Filed: Sep. 19, 2005

(86) PCT No.: PCT/IB2005/053064

§ 371 (c)(1),
(2), (4) Date: Mar. 19, 2007

(87) PCT Pub. No.: WO2006/033071

PCT Pub. Date: Mar. 30, 2006

(65) Prior Publication Data

US 2008/0218300 A1 Sep. 11, 2008

(30) Foreign Application Priority Data

Sep. 24, 2004 (EP) ..... 04104662

(51) Int. Cl.
*H01F 5/00* (2006.01)
*H01F 27/10* (2006.01)
*H01F 27/28* (2006.01)

(52) U.S. Cl. ..... 336/200; 336/58; 336/232

(58) Field of Classification Search ..... 336/58, 336/200, 232

See application file for complete search history.

(56) References Cited

U.S. PATENT DOCUMENTS

| | | | | |
|---|---|---|---|---|
| 4,100,480 | A * | 7/1978 | Lytle et al. | 340/870.35 |
| 4,520,494 | A * | 5/1985 | Arita et al. | 378/108 |
| 4,763,093 | A | 8/1988 | Cirkel et al. | |
| 4,873,757 | A * | 10/1989 | Williams | 29/602.1 |
| 4,937,729 | A | 6/1990 | Gadreau et al. | |
| 5,225,803 | A * | 7/1993 | Negle et al. | 336/208 |
| 5,631,815 | A | 5/1997 | Cross | |
| 5,847,947 | A | 12/1998 | Pan et al. | |
| 6,211,767 | B1 | 4/2001 | Jitaru | |
| 2002/0036561 | A1 | 3/2002 | Jedlitschka | |
| 2003/0132825 | A1 | 7/2003 | Gamou | |

FOREIGN PATENT DOCUMENTS

WO 0122445 A1 3/2001

OTHER PUBLICATIONS

Conor Quinn et al; "A Review of Planar Magnetic Techniques and Technologies", Applied Power Electronics Conf. and Exposition, 2001, APEC 2001, 16th Annual IEEE 2001, vol. 2, Mar. 4-8, 2001, pp. 1175-1183.

* cited by examiner

*Primary Examiner* — Elvin G Enad
*Assistant Examiner* — Tszfung Chan

(57) ABSTRACT

The invention relates to a transformer (12) with a planar primary winding and a planar secondary winding. In order to support the heat dissipation during operation, each winding is integrated on a substrate in at least one dedicated PCB (30, 40). The PCBs (30, 40) are separated from each other by a non-ferromagnetic and electrically insulating material (50). The material: (50) transfers heat better than the substrates. The invention relates equally to an apparatus comprising such a transformer (12).

14 Claims, 5 Drawing Sheets

TRANSFORMER

The invention relates to a transformer and to an apparatus comprising a transformer, particularly to an X-ray imaging apparatus.

Some electrical loads require a high voltage for their power supply. X-ray tubes for medical applications, for example, typically need an acceleration voltage of 15 kV to 160 kV, relating to applications like mammography to computed tomography. X-ray tubes for industrial applications even need voltages of up to 400 kV. The supplied power can reach from a few Watt to more than 100 kW.

High voltages can be obtained by means of a high voltage transformer, which generates a high output voltage from an available low input voltage.

A high voltage transformer usually comprises a core, for operation frequencies of about 50 kHz to about 400 kHz typically a ferrite core. On the core, primary and secondary windings are arranged, the input voltage being fed to the terminals of the primary winding and the output voltage being provided by the terminals of the secondary winding.

The core is usually either a U-core having two legs or an E-core having three legs. The windings can be arranged on one or more legs of the core and in addition on the connection portion of the core connecting the legs.

Conventionally, wires having a circular cross section are used for realizing the windings of a transformer. A first coil may be arranged for instance as a primary winding around a first leg of a core, while a second coil is arranged as a secondary winding around a second leg of a core, or both coils may be arranged nested around the same leg of a core.

Instead of a winding made of wire, for instance a foil or a planar winding could be used. A planar winding comprises one or more turns made of flat bands having a rectangular cross-section. A planar winding results in a reduced winding capacity and in a higher reproducibility of the structure.

The magnetic field resulting during the operation of a transformer causes eddy current losses. Any type of winding reacts more specifically to the components of the magnetic field which are perpendicular to the conductors and lie in the plane of the cross section of the conductors.

In the case of wire-based windings, exclusively the amplitude of the magnetic field is of relevance for the losses, not its direction. In the case of a planar winding, only the component of the magnetic field perpendicular to the long edge of the rectangular cross-section is of importance for the losses, while the component of the magnetic field parallel to this edge is rather insignificant.

If the primary or secondary winding is realized as a planar winding in a transformer designed for a wire-based primary or secondary winding, then there will usually be significant components of the magnetic field which are perpendicular to the long edges of the turns of the planar secondary winding and which lead to significant eddy current losses.

The document "A Review of Planar Magnetic Techniques and Technologies", Applied Power Electronics Conference and Exposition, 2001, APEC 2001, Sixteenth Annual IEEE 2001, Volume 2, 4-8 Mar. 2001, pages 1175-1183, by C. Quinn, K. Rinne, T. O'Donnell, M. Duffy and C. O. Mathuna, deals with entirely planar magnetic structures. As technologies to implement planar windings, printed circuit boards (PCB), flex circuits and stamped copper are mentioned. PCBs are indicated to be highly repeatable and producible means of implementing planar windings. A typical PCB planar magnetic transformer is presented, which consists of a low-profile E-core and a four-layer PCB, in which eight primary turns are sandwiched between two secondary turns.

Such a PCB has the disadvantage of a poor heat dissipation. The secondary winding hampers heat removal from the primary winding sandwiched between the turns of the secondary winding. Furthermore, for a high voltage transformer such a PCB has the disadvantage of a poor electrical insulation between the low voltage primary winding and the high voltage secondary winding.

It is an object of the invention to provide an improved transformer and improved apparatuses comprising a transformer.

The object is reached with a transformer comprising at least a first PCB with a planar primary winding on a substrate and at least a second PCB with a planar secondary winding on a substrate, wherein the first PCB and the second PCB are separated from each other by a non-ferromagnetic and electrically insulating material, which material transfers heat better than the substrates.

The object is further reached with an apparatus including such a transformer, particularly with an X-ray imaging apparatus including such a transformer.

The invention proceeds from the idea that the windings of a transformer realized with PCB technology do not have to be integrated in a single PCB. Instead, planar primary and secondary windings of a transformer can be realized with at least two separate PCBs which are not in electrical contact with each other. The PCBs can be separated from each other by any material which is non-ferromagnetic and electrically insulating. In addition, the material should transfer heat better than the substrates of the PCBs. To this end, the material may either have a heat conductivity that exceeds the heat conductivity of the substrates or allow for convective heat transfer.

It is an advantage of the invention that using separate PCBs for primary and secondary windings enables improved heat dissipation via a suitably selected separating material. It is further an advantage of the invention that using separate PCBs for primary and secondary windings enables improved electrical insulation between them. It is further an advantage of the invention that using separate PCBs for primary and secondary windings makes the construction of transformers easy and flexible. Since the primary winding and the secondary winding are arranged on separate PCBs, the same PCBs can be used in different constellations, for instance with differing combinations of primary and secondary windings or with different insulating materials.

Moreover, the invention maintains the advantages of planar windings which are realized with PCBs. Due to the use of planar windings, the construction of the transformer can be compact, small and light. Compared to a wire-based winding layout, moreover the winding capacitance can be reduced. The use of PCBs improves the electrical insulation characteristics, since the high voltage windings can be encapsulated entirely. The use of PCBs makes the winding layout moreover particularly reproducible. Using PCBs for both, primary and secondary windings, further allows realizing complex winding structures on both sides of the transformer.

In one embodiment of the invention, the material between the at least two PCBs comprises a fluid, even though it has to be noted that this is not a requirement. Using such a gaseous or liquid material has the advantage that the overall heat transfer can be increased significantly by convective heat transfer. The fluid may be for instance sulfur hexafluoride in a gap between the PCBs, or it may comprise for instance transformer oil.

In order to ensure that the transformer is suited for high voltage applications, a certain insulation distance has to be kept between the primary and the secondary windings. A large insulation distance results in a small strength of the electric field between two PCBs, which limits the stress on an insulating material between these PCBs. If the transformer comprises a core, and if the core is grounded or if there is for some other reason a potential difference between the core and a winding, a certain insulation distance has to be kept between this winding and the core as well.

Large insulating distances have the disadvantage, though, that they increase the total size of the transformer for a given desired effective cross-section of the windings.

The required insulation distance can be decreased, and thus the effective winding cross section be increased and the winding resistance be reduced, if the voltage potential of one termination of a winding is reduced, for instance by grounding.

In one embodiment of the invention, the transformer comprises a core with at least one core leg around which the PCBs are arranged. A winding of at least one of the PCBs comprises during operation of the transformer a winding portion with a higher voltage potential and a winding portion with a smaller voltage potential. The winding portion with the smaller voltage potential can then be arranged within this PCB closer to the at least one core leg than a winding portion with the higher voltage potential.

The eddy current losses in the windings can be reduced for example by a special winding arrangement. If the windings are arranged symmetrically to a horizontal line and to a vertical line through the center of a core window which is passed by the windings, there will be less magnetic field components perpendicular to the long edges of the winding cross section, and as a result, the eddy current loss is reduced.

If at least one of the PCBs comprises a plurality of layers, and if a winding of this PCB comprises a plurality of turns distributed to the layers, this may be achieved by arranging the turns symmetrically to an imaginary line parallel to a core leg around which the PCB is arranged.

The transformer may also comprise more than one PCB for primary windings and/or more than one PCB for secondary windings. Increasing the number of PCBs allows an even better heat dissipation. When several PCBs are available, they are preferably arranged such that sides of the PCBs with different potential result in an electrical field strength in the spaces between the PCBs which is as small as possible.

In one embodiment of the invention, the transformer comprises more than one PCB for primary windings, more than one PCB for secondary windings and a core with a window through which the PCBs pass. The core window may then be divided into a plurality of window portions and the PCBs may be arranged in a symmetrical manner not only in the core window, but also in each of the window portions. Due to the symmetry within several window portions, the current will be distributed more evenly, if all primary windings are connected in parallel and all secondary windings are connected in parallel. Moreover, the maximal magnetic field strength is reduced, which results in less eddy current losses.

The invention can be employed with any transformer, in particular with high-voltage transformers which generate a high output voltage from a low input voltage. The transformer according to the invention can moreover be employed for any application requiring a transformer. It can be used for instance for generating a high voltage for an x-ray tube. For cardio vascular and computer tomography, for instance, the employed x-ray system requires a powerful high-voltage generator having a limited size and weight.

The apparatus according to the invention can be for instance a power supply apparatus which is able to provide a power supply for a load. Alternatively, it can be for instance an apparatus which comprises a load and in addition a power supply portion providing a power supply for the load. The apparatus according to the invention can also be an X-ray imaging apparatus, e.g. a mammography apparatus, a radiography apparatus, or a computed tomography (CT) apparatus.

These and other aspects of the invention will be apparent from and elucidated with reference to the embodiment(s) described hereinafter.

Figure 1:
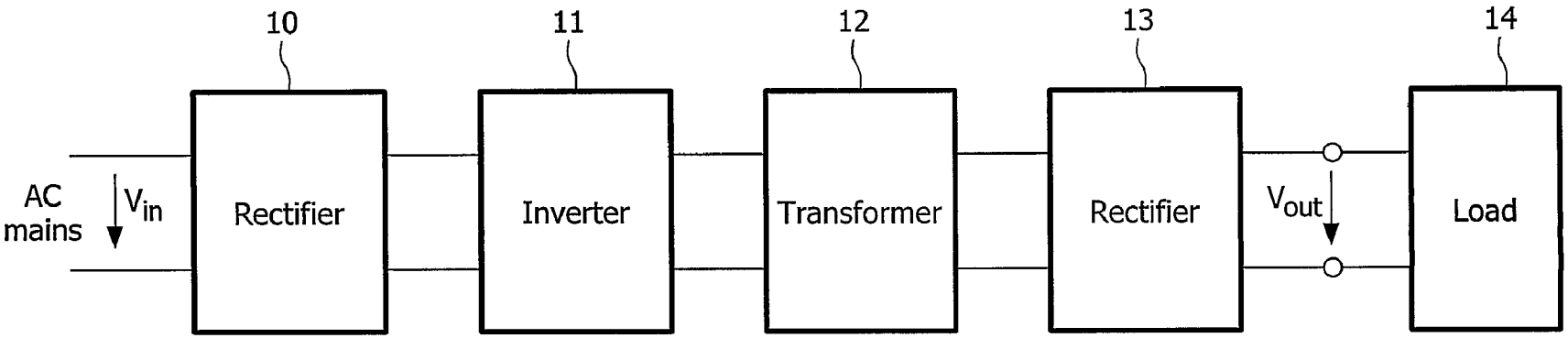
FIG. 1 is a schematic diagram of an exemplary apparatus in which the invention can be implemented.

FIG. 1 is a schematic block diagram of an apparatus in which the invention can be implemented. The apparatus includes a load and a power supply portion providing a power supply for the load. The apparatus could be an X-ray imaging apparatus that has an X-ray tube as load 14.

The power supply portion comprises a first rectifier 10, an inverter 11, a high voltage transformer 12 and a second rectifier 13. The first rectifier 10 rectifies a line voltage $V_{in}$ provided by AC mains. The rectified voltage is provided to the inverter 11, which converts the rectified voltage into a high frequency square wave voltage. The high voltage transformer 12 raises this square wave voltage to a higher voltage level. The second rectifier 13 rectifies the resulting high level alternating voltage to obtain a high level direct voltage $V_{out}$. The high level direct voltage $V_{out}$ is provided to a load 14, for example to an x-ray tube.

Figure 2:
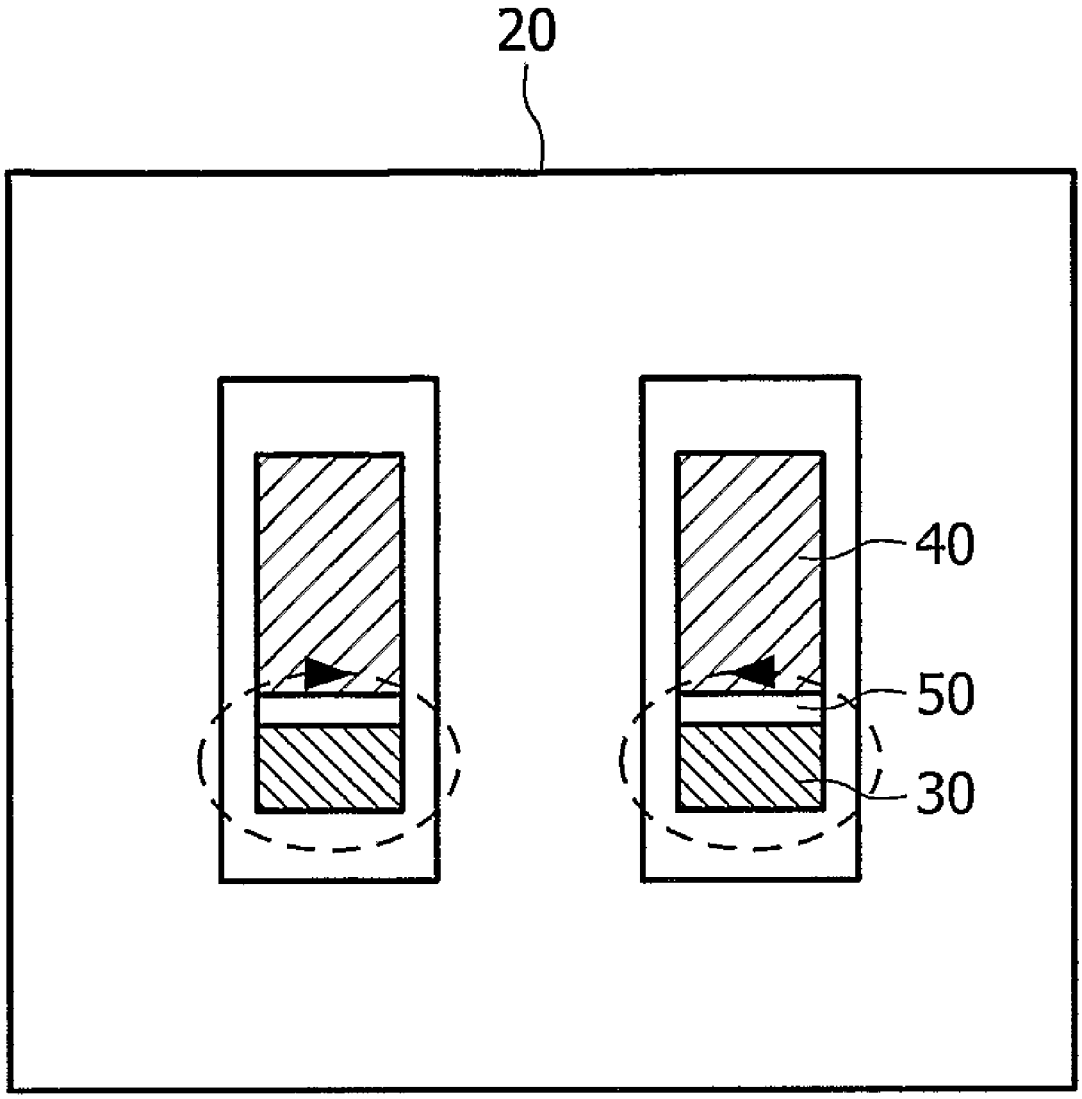
FIG. 2 is a schematic cross-sectional view of a transformer according to a first embodiment of the invention.

A first embodiment of the high voltage transformer 12 of FIG. 1 is presented in FIG. 2.

FIG. 2 is a schematic cross-sectional view of a transformer 12 with an E-core 20. The core 20 is made, for instance, of a ferrite material. A planar primary winding formed on a substrate of a first PCB 30 is arranged around the middle leg of the core 20. A planar secondary winding formed on a substrate of a separate second PCB 40 is equally arranged around the middle leg of the core 20 above the first PCB 30. The first PCB 30 and the second PCB 40 are separated from each other by a layer 50 of non-ferromagnetic, electrically insulating and heat-transferring material. The layer 50 transfers heat better than the substrates employed for the PCBs 30, 40 due to having a heat conductivity that exceeds the heat conductivity of the substrates or due to allowing for convective heat transfer. The layer 50 may comprise for instance transformer oil or be realized by a gap filled with sulfur hexafluoride. The provision of an insulation layer 50 enables a cooling of the windings, which are heating up when the transformer 12 is in use. If the primary and the secondary windings are basically symmetrical to a vertical line through the middle of each core window, the leakage fields are horizontal and parallel to the long edges of the turns of the windings, as indicated by arrows with dashed lines in FIG. 2. As a result, the eddy current losses in the secondary winding of PCB 40 are minimized.

For constructing the transformer 12, first the PCB 30 with the primary winding is mounted on the middle leg of the core 20, then the isolation layer 50 is mounted on the middle leg of the core 20 next to the PCB 30, and finally the PCB 40 with the secondary winding is mounted on the middle leg of the core 20 next to the insulation layer 50.

Instead of a single primary winding and a single secondary winding, a plurality of primary and secondary windings can be employed. A plurality of primary and/or secondary windings can be employed in particular, in order to achieve in addition to a vertical symmetry as well a horizontal symmetry in the core windows.

FIGS. 3 to 6 are schematic cross-sectional views of transformers 12 which comprise a U-core 21 and a horizontal symmetry of windings in the window of the U-core 21.

Figure 3:
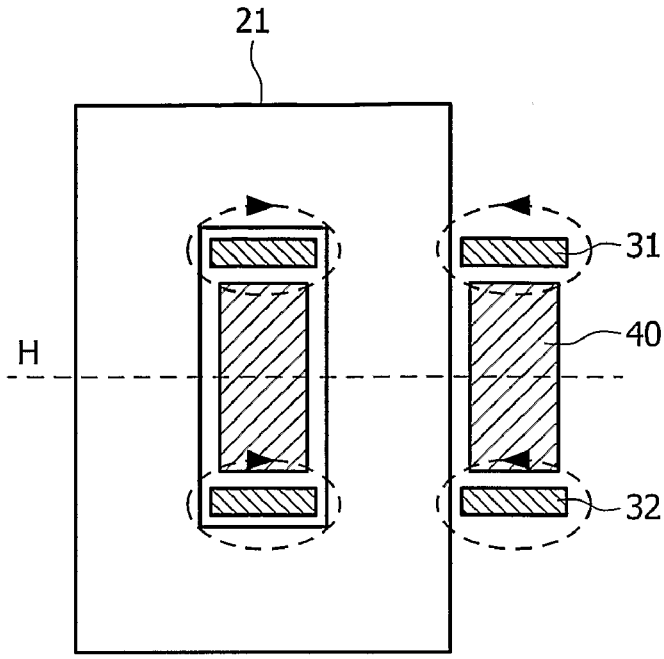
FIG. 3 is a schematic cross-sectional view of a transformer according to a second embodiment of the invention.

In the transformer 12 of FIG. 3, a PCB 40 with a secondary winding is mounted on the right leg of the U-core 21. In the window of the U-core 21, the PCB 40 is arranged to be symmetrical to a vertical line through the center of the window and symmetrical to a horizontal line H through the center of the window.

A first PCB 31 with a primary winding is mounted on the right leg of the U-core 21 above the PCB 40 with the secondary winding, while a second PCB 32 with a primary winding is mounted on the right leg of the U-core 21 below the PCB 40 with the secondary winding. The PCBs 31, 32 with the primary windings are arranged as well to be symmetrical to a vertical line through the center of the window. Moreover, the PCBs 31, 32 with the primary windings are identical to each other and arranged at the same distance to the PCB 40 with the secondary winding. The gap between the PCB 40 with the secondary winding and the PCBs 31, 32 with the primary windings are filled with transformer oil or sulfur hexafluoride as an insulating material.

The primary windings of the first PCB 31 and the second PCB 32 are connected in parallel, so that the current is divided equally to both primary windings due to the symmetry in the core window. The leakage fields are indicated by arrows with dashed lines in FIG. 3. The maximum field strength is lower than in FIG. 2, which results in lower eddy current losses on the secondary side.

Figure 4:
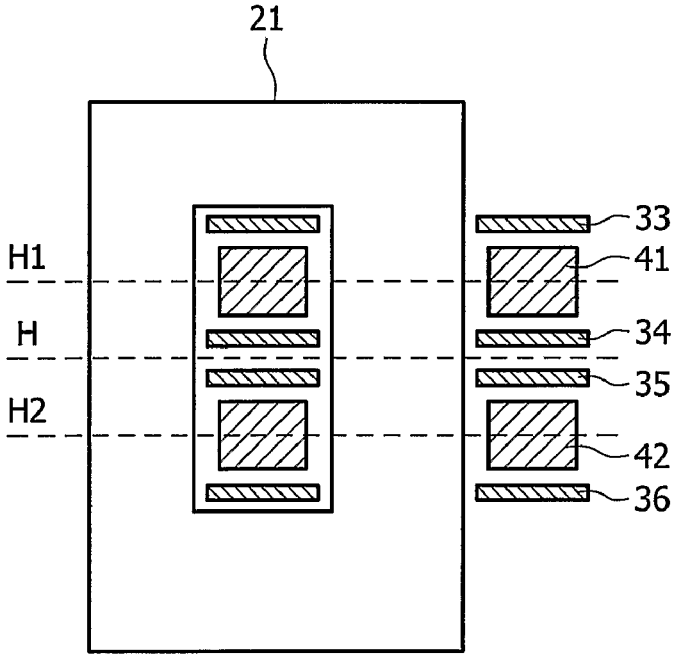
FIG. 4 is a schematic cross-sectional view of a transformer according to a third embodiment of the invention.

In the transformer 12 of FIG. 4, six PCBs 33, 34, 35, 36, 41, 42 are mounted on the right leg of the U-core 21.

The window of the U-core 21 is divided by a first imaginary horizontal line H into an upper part and a lower part of the same size.

A first PCB 41 with a secondary winding is arranged symmetrically to a horizontal line H1 through the middle of the upper part of the core window. A first PCB 33 with a primary winding is arranged within the upper part of the core window above the first PCB 41 with the secondary winding, while a second PCB 34 with a primary winding is arranged within the upper part of the core window below the first PCB 41 with the secondary winding.

A second PCB 42 with a secondary winding is arranged symmetrically to a horizontal line H2 through the middle of the lower part of the core window. A third PCB 35 with a primary winding is arranged within the lower part of the core window above the second PCB 42 with the secondary winding, while a fourth PCB 36 with a primary winding is arranged within the lower part of the core window below the second PCB 42 with the secondary winding.

All PCBs 33, 34, 35, 36, 41, 42 are arranged in addition to be symmetrical to a vertical line through the center of the window of the core 21.

The PCBs 33, 34, 35, 36 with the primary windings are identical to each other and the PCBs 41, 42 with the secondary windings are identical to each other. Moreover, the distances between each PCB 33, 34, 35, 36 with a primary windings and the respective next PCBs 41, 42 with a secondary windings are the same.

All four primary windings are connected in parallel, so that the current is distributed evenly in the core window due to the additional symmetry in the core window. Moreover, the maximum field strength is further reduced, resulting in even less eddy current losses on the secondary side.

Figure 5:
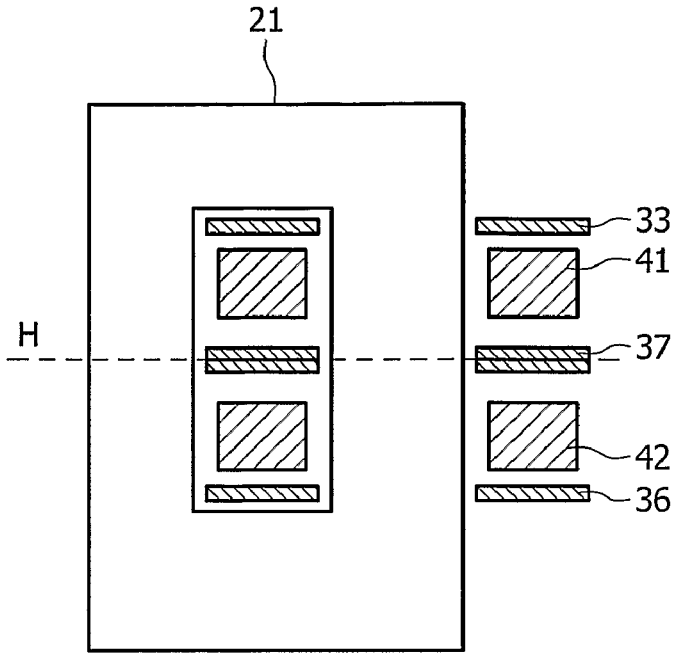
FIG. 5 is a schematic cross-sectional view of a transformer according to a fourth embodiment of the invention.

The transformer 12 of FIG. 5 corresponds to the transformer of FIG. 4, except that the second and the third PCB 34, 35 with a primary winding are combined to a single PCB 37 with a primary winding. It has to be noted, however, that in FIG. 4, the primary windings can be cooled to a larger extent by a medium due to the gap between the second and the third PCB 34, 35.

Figure 6:
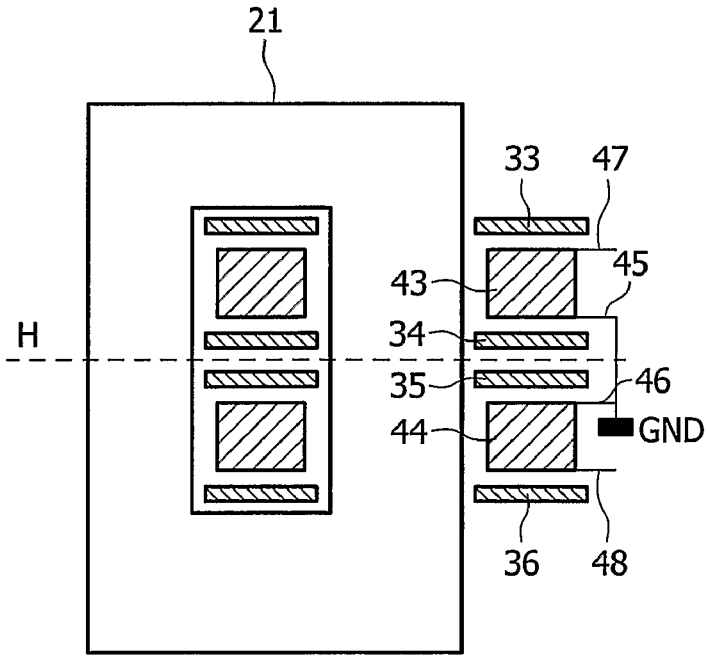
FIG. 6 is a schematic cross-sectional view of a transformer according to a fifth embodiment of the invention.
Figure 7:
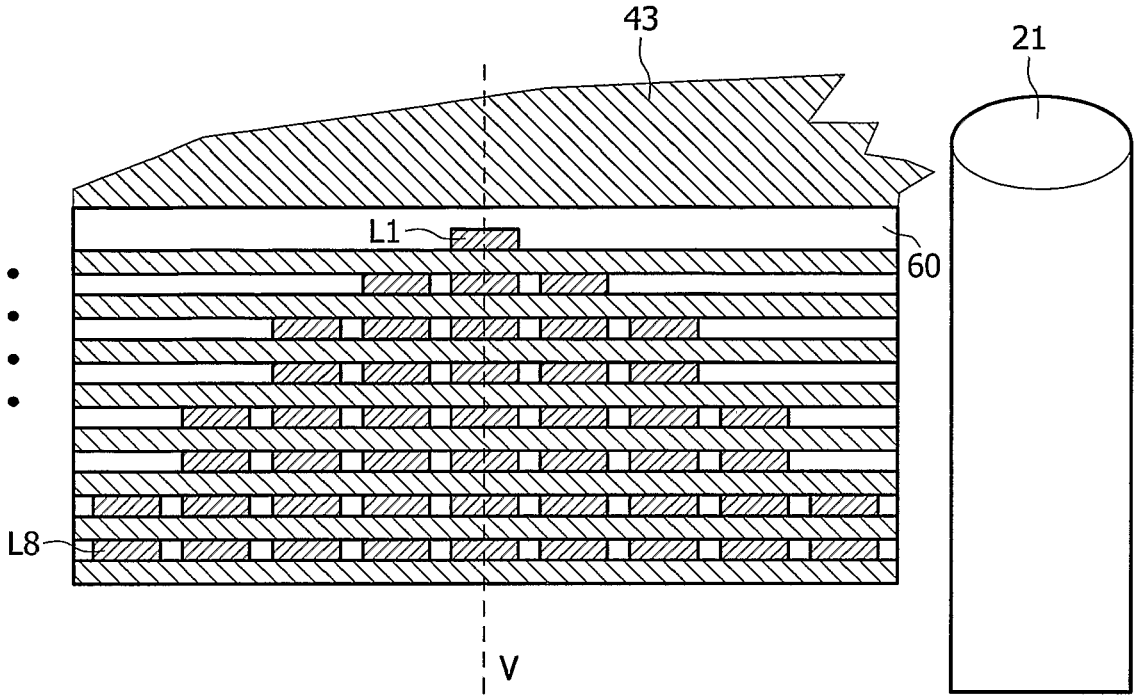
FIG. 7 is a schematic diagram illustrating details of a transformer according to an embodiment of the invention.

The required insulation distances between the primary and the secondary windings and the required insulation distances between the secondary winding and the core 21 can partly be reduced, for example in the transformer 12 of FIG. 4 as illustrated in FIGS. 6 and 7.

The transformer 12 of FIG. 6 has basically the same structure as the transformer 12 of FIG. 4. Instead of non-grounded PCBs 41, 42, however, grounded PCBs 43, 44 are provided for the secondary windings. The respective termination 45, 46 of the secondary winding of the PCBs 43, 44, which is closer to the center of the core window, is connected to ground GND. As a result, these terminations 45, 46 can have a smaller isolation distance to the respective neighboring primary winding of the PCBs 34 and 35 as well as to the core 21 than the other terminations 47, 48. A partial reduction of the isolation distances allows increasing the effective cross-section of the secondary windings of PCBs 43 and 44 with a given core window size. The resulting unequal distribution of the current in the primary windings of the PCBs 33, 34, 35 and 36, which imply a higher loss, can be compensated by the increased cross-section.

In FIG. 6, it can be seen that, compared to the PCBs 41 and 42 of FIG. 4, the PCBs 43 and 44 are lengthened in direction of the PCBs 34 and 35, respectively, in order to increase the effective cross-section of the secondary windings.

FIG. 7 presents details of the PCB 43 of the transformer 12 of FIG. 6, in which moreover the distance of the winding to the core 21 is optimized in order to obtain a large effective cross-section of the secondary windings.

FIG. 7 is a schematic cross-sectional view of the PCB 43. In addition, the right leg of the core 21 on which the PCB 43 is mounted is shown. The PCB 43 as a whole has a rectangular cross-section. The PCB 43 comprises a multi-layer winding encapsulated by insulating material 60 filling the rectangular cross-section. The winding comprises in each layer L1, . . . , L8 one or more turns. The number of turns increases from the highest layer L1 to the lowest layer L8, such that the lowest layers L8 comprise the highest number of turns and the highest layer L1 the smallest number of turns. The turns in each layer L1, . . . , L8 are arranged symmetrically around a vertical line V through the middle of the core window. Thus, the closest distance between the winding in the lower layers L8 etc. and the core leg is smaller than the closest distance between the winding in the higher layers L1 etc. and the core leg. Even though the PCB 43 as a whole has a uniform distance to the core leg, there is consequently less insulating material between the winding in the lower layers L8 etc. and the core leg than between the winding in the higher layers L1 etc. and the core leg. The winding has a first termination in the highest layer L1 and a second termination in the lowest layer L8. The termination in the lowest winding layer L8 is grounded (not shown).

Since the lowest winding layer is grounded, it has a lower voltage potential than the higher winding layers. As a result, it requires a lower insulation distance to the core leg than the higher layers, that is, it can be arranged closer to the core leg. This allows a better exploitation of the core window and a reduced winding resistance. Nevertheless, a vertical symmetry in the core window is maintained.

The second PCB 44 of the transformer 12 of FIG. 6 is constructed in an identical manner, it is only mirrored horizontally.

The PCB presented in FIG. 7 could be employed in other transformer constellations as well.

It is understood that the described embodiments of the invention represent only some of a great variety of possible embodiments of the invention. For example, in the transformer of any of FIGS. 2 to 7, the primary windings and the secondary windings could be exchanged. Moreover, reference signs in the claims are not intended to limit the scope of the claims but only to facilitate an easy understanding of the claims. It is further understood that the term "comprising" in the claims does not exclude other elements or steps, and that the terms "a" or "an" in the claims does not exclude a plurality.

The invention claimed is:

1. A transformer comprising:

at least one first printed circuit board with a planar primary winding on a substrate;

at least one second printed circuit board with a planar secondary winding on a substrate; and a core with at least one core leg around which said printed circuit boards are arranged, wherein said at least one second printed circuit board includes a plurality of layers and a multi-layer secondary winding, wherein each layer of the plurality of layers contains one or more winding turns of the multi-layer secondary winding, wherein the multi-layer secondary winding of the plurality of layers comprises (i) a first portion of the multi-layer secondary winding for being coupled with a higher voltage potential during operation, (ii) a second portion of the multi-layer secondary winding for being coupled with a smaller voltage potential during operation, (iii) wherein the number of winding turns increases from a smallest number of turns in the first portion of the multilayer secondary winding to a highest number of turns in the second portion of the multilayer secondary winding, further wherein turns of each layer of the multilayer secondary winding are arranged symmetrically around a vertical line through a middle of a core window of the core, and (iv) wherein said first portion of the multi-layer secondary winding is arranged within a corresponding layer of the plurality of layers of the at least one second printed circuit board, and said second portion of the multi-layer secondary winding is arranged within a respective corresponding layer of the plurality of layers of said at least one second printed circuit board such that a closest distance between a respective winding of the second portion and the core leg is smaller than a closest distance between a respective winding of the first portion and the core leg, wherein said at least one first printed circuit board and said at least one second printed circuit board are separated from each other by a non-ferromagnetic and electrically insulating material, which material transfers heat better than said substrates.

2. The transformer according to claim 1, wherein said material comprises a fluid.

3. The transformer according to claim 1, wherein one termination of a winding of at least one of said printed circuit boards is grounded.

4. The transformer according to claim 1, further wherein said core comprises a core having at least two core legs, which limit two sides of at least one core window, wherein said at least one first printed circuit board with a planar primary winding comprises a plurality of first printed circuit boards;

wherein said at least one second printed circuit board with a planar secondary winding comprises a plurality of second printed circuit boards;

wherein said first printed circuit boards and said second printed circuit boards are arranged around a first one of said at least two core legs; and wherein said at least one core window is subdivided into a plurality of window portions along said first one of said at least two core legs, wherein said first printed circuit boards and said second printed circuit boards are distributed to said plurality of window portions, and wherein said first printed circuit boards and said second printed circuit boards are arranged in each of said window portions essentially symmetrically to a respective imaginary line dividing a respective window portion into halves arranged along said first one of said at least two core legs.

5. The transformer according to claim 1, further comprising a second at least one second printed circuit board constructed in an identical manner as the first at least one second printed circuit board, only mirrored horizontally.

6. The transformer according to claim 1, wherein the first portion of the multi-layer secondary winding is included in a highest layer of the at least one second printed circuit board, and wherein the second portion of the multi-layer secondary winding is included in a lowest layer of the at least one second printed circuit board.

7. The transformer according to claim 6, wherein the multi-layer secondary winding further includes a first termination in the highest layer and a second termination in the lowest layer.

8. An apparatus including a transformer, said transformer comprising:

at least one first printed circuit board with a planar primary winding on a substrate;

at least one second printed circuit board with a planar secondary winding on a substrate; and a core with at least one core leg around which said printed circuit boards are arranged, wherein said at least one second printed circuit board includes a plurality of layers and a multi-layer secondary winding, wherein each layer of the plurality of layers contains one or more winding turns of the multi-layer secondary winding, wherein the multi-layer secondary winding of the plurality of layers comprises (i) a first portion of the multi-layer secondary winding for being coupled with a higher voltage potential during operation and (ii) a second portion of the multi-layer secondary winding for being coupled with a smaller voltage potential during operation, (iii) wherein the number of winding turns increases from a smallest number of turns in the first portion of the multilayer secondary winding to a highest number of turns in the second portion of the multilayer secondary winding, further wherein turns of each layer of the multilayer secondary winding are arranged symmetrically around a vertical line through a middle of a core window of the core, and (iv) wherein said first portion of the multi-layer secondary winding is arranged within a corresponding layer of the plurality of layers of the at least one second printed circuit board, and said second portion of the multi-layer secondary winding is arranged within a respective corresponding layer of the plurality of layers of said at least one second printed circuit board such that a closest distance between a respective winding of the second portion and the core leg is smaller than a closest distance between a respective winding of the first portion and the core leg, wherein said at least one first printed circuit board and said at least one second printed circuit board are separated from each other by a non-ferromagnetic and electrically insulating material, which material transfers heat better than said substrates.

9. The apparatus according to claim 8, wherein said apparatus is a power supply apparatus, which is adapted to provide a supply voltage to a load.

10. The apparatus according to claim 8, wherein said apparatus comprises a load and a power supply portion including said transformer, wherein said power supply portion is adapted to provide a supply voltage to said load.

11. The apparatus according to claim 10, wherein the apparatus is an X-ray imaging apparatus and the load is an X-ray tube.

12. The apparatus according to claim 8, further comprising a second at least one second printed circuit board constructed in an identical manner as the first at least one second printed circuit board, only mirrored horizontally.

13. The apparatus according to claim 8, wherein the first portion of the multi-layer secondary winding is included in a highest layer of the at least one second printed circuit board, and wherein the second portion of the multi-layer secondary winding is included in a lowest layer of the at least one second printed circuit board.

14. The apparatus according to claim 13, wherein the multi-layer secondary winding further includes a first termination in the highest layer and a second termination in the lowest layer.

* * * * *